US005755338A

United States Patent [19]

vom Braucke et al.

[11] Patent Number: 5,755,338

[45] Date of Patent: May 26, 1998

[54] BULLETIN BOARD HAVING STORAGE COMPARTMENTS

[75] Inventors: Manfred vom Braucke; Hans vom Braucke, both of Bielefeld, Germany

[73] Assignee: Bielefelder Kuchenmaschinen- und Transportgerate-Fabrik vom Braucke GmbH, Bielefeld, Germany

[21] Appl. No.: 674,872

[22] Filed: Jul. 2, 1996

[30] Foreign Application Priority Data

Jul. 5, 1995 [DE] Germany ..... 295 10 667.0

[51] Int. Cl.[6] ..... A47F 5/00

[52] U.S. Cl. ..... 211/13.1; 211/69.1; 211/88.01; 211/DIG. 1; 248/206.5

[58] Field of Search ..... 211/13.1, 69.1, 211/69.5, 87.01, 88.01, DIG. 1, 10, 11; 248/206.5

[56] References Cited

U.S. PATENT DOCUMENTS

| | | | |
|---|---|---|---|
| D. 349,733 | 8/1994 | Svee | D19/52 X |
| 3,684,102 | 8/1972 | Colter | 211/88.01 |
| 3,842,982 | 10/1974 | Joyce . | |
| 4,133,123 | 1/1979 | Anderson | D19/52 X |
| 4,362,248 | 12/1982 | Vilanova | 211/13.1 X |
| 5,097,961 | 3/1992 | Patino et al. | 211/10 |
| 5,232,103 | 8/1993 | Koenig et al. | 211/69.5 |
| 5,265,735 | 11/1993 | Hassel et al. | 211/11 |
| 5,309,659 | 5/1994 | Eastman | 248/206.5 X |
| 5,460,305 | 10/1995 | Ahearn | 211/DIG. 1 |

FOREIGN PATENT DOCUMENTS

| | | |
|---|---|---|
| E/47 015 | 4/1990 | Austria . |
| 0 282 238 | 9/1988 | European Pat. Off. . |
| 1 779 092 | 9/1971 | Germany . |
| 73/31 049 | 1/1974 | Germany . |

*Primary Examiner*—Robert W. Gibson, Jr.

*Attorney, Agent, or Firm*—Burns, Doane, Swecker & Mathis, L.L.P.

[57] ABSTRACT

A bulletin board structure includes a ferromagnetic board which is coated so that it can be written on, and a container removably mounted on a lower end of the board. The container includes a plurality of upwardly open compartments. At least one of the compartments has slots formed in opposing walls thereof for receiving the axle stubs of a tape roll. The container can also include holes for receiving hooks.

24 Claims, 2 Drawing Sheets

BULLETIN BOARD HAVING STORAGE COMPARTMENTS

BACKGROUND OF THE INVENTION

This invention relates to a bulletin board, especially for household or kitchen use, comprising a ferromagnetic board, at whose lower edge a depository is attached in a form-locking or force-locking manner.

Bulletin boards are preferably known in connection with office use; here, magnetic retaining forces are used to hold plans or notes with permanent magnetic holders upon ferromagnetic bulletin boards. It is also known that one can make these bulletin boards, for example, so that they can be written on with fiber pens where the written text can at all times be easily wiped off with a wiper. To deposit felt-tipped pens, depositories are provided along the lower edge of such bulletin boards at a right angle to the plane of such boards. In household use, bulletin boards are also known as PIN walls where the notes to be kept are attached by means of pins, common pins, thumbtacks or the like to the bulletin board that frequently consists of cork. Here, there are no depositories; notices are put on paper (possibly stocked on the PIN wall) and are tacked upon the PIN wall. On the other hand, for use in kitchens, one also uses rollers that are equipped with one or several foil rolls and that are often provided with a deposit for small objects such as thumbtacks, rubber bands or the like. PIN walls offer the possibility of deposits with their rough surface, especially in kitchens; but the rollers do not have the desired and often needed marking possibilities.

SUMMARY OF THE INVENTION

This introduces the invention whose object is to develop a known bulletin board that can be universally used in kitchens and, by way of expanding the task, that can also be employed as a wall container or as a table container.

The depository connected to a bulletin board according to the invention is in the form of a utensil container that has at least one vertical (but preferably more than one) compartment that is open on the top. This design permits multiple deposits. It is advantageous to subdivide this utensil container roughly halfway up its height into upper and lower sectors. The divider here is a horizontal partition plate that extends at least over a part of the width of the utensil container. As a result, the bulletin board is provided with a multifunctional deposit possibility in the form of the utensil container, and it can be used in many different ways.

The upper sector of the utensil container essentially has the vertical compartments that are open on the top. Preferably, the utensil container is disposed under the deposit cup, and has a hook bar processing means for the insertion of hooks or the like. In that way, the space under the deposit cup can be used to attach means, or to suspend objects, whereby these means can also be made in the form of containers. Objects to be preserved can be inserted thereinto. Advantageously, the hook bar has a spacing with respect to the plane of the rear wall that permits the insertion of hooks or the like.

For suspension purposes, the hook bar has holes at intervals, arranged in a regular pattern, as means for the attachment of hooks or the like, into which the hooks can be inserted in a removable manner. In another embodiment, suspension slits are arranged at intervals in a regular pattern as means for the attachment of suspension cups or the like, into which suspension cups can be suspended in a removable manner. The perforation patterns and suspension slits can also be provided together in combination. Hooks can be inserted in the holes, as is known from conventional perforated boards. In the suspension slits, one can suspend stacking containers provided with corresponding hooks, so that additional deposit space is created for bulk materials. Here, the spacing from the rear wall plane provides the space necessary to enable the hook bars to be guided through the holes or slits without problems and can be suspended.

Advantageously, the depository contained in the lower sector at its lower edge has a deposit rim defining a lower termination so that one gets an essentially horizontally aligned compartment. In an advantageous development, a deposit cup, subdivided by partitions, is provided in the upper middle sector. As a further development, the cup is limited by a first partition that extends parallel to the rear wall, and the latter, together with the rear wall, forms an insertion compartment with a depth of at most ¼ of the depth of the deposit cup. This relatively narrow insertion compartment that extends over the entire height of the deposit cup can be used in order, for example, to insert note pads, especially those note pads that are provided with an adhesive edge, but also loose slips. This insertion compartment makes it possible always to have a supply of note slips ready for use.

To be able to insert longer objects such as, for example, scissors, screwdrivers and the like, at least one of the compartments advantageously forms an insertion compartment that extends over the entire height of the utensil container. For this insertion compartment, the horizontal subdivision plate is interrupted or, when the insertion compartment is disposed along the edge, it is shortened. A deposit cup is provided in the middle sector as a further development. Advantageously, at least one additional partition is provided in the deposit cup, and that partition subdivides the front portion of the deposit cup into individual cups. In that way, one can always stock small objects, for example, thumbtacks, rubber bands, paper clips of all kinds or the like, separately and easily accessible.

In another preferred embodiment, one of the compartments is made as a receiving compartment for an adhesive tape roll. The adhesive tape roll is disposed on a core that is provided on both sides with axle stubs. To be able to fix the adhesive tape roll in its receiving compartment, these axle stubs engage means for holding the axles, with which the front wall and the subdivision wall of the receiving compartment for the adhesive tape roll are provided. In a particular embodiment, axle receptacles formed by internal bars are provided as such means. As an alternative, axle receptacles formed by grooves are provided as such means. The axle receptacles thus formed make it possible to fix the adhesive tape roll in its reception compartment.

Advantageously, the axle receptacles are L-shaped, with bearing sides thereof pointing roughly in the direction in which the adhesive tape is pulled off. Due to this design, the axle bearings assume a defined contact surface at least as the adhesive tape is pulled off. Moreover, if these bearing sides are inclined downward, the adhesive tape roll is guided in its support when not in use, so that the adhesive tape roll, upon being unwound, is already in its contact position. As an advantageous development, the transition to the bearing side could be provided with a constriction, whereby the axle bearings cannot inadvertently slide out of the bearing sides; it would take a certain force to remove the roller core. This means that the security of the bearing is improved.

In a preferred embodiment, the insertion compartment on the left side of the deposit cup and the reception compartment for the adhesive tape roll are provided on the right side of the roll. This arrangement is designed for right-handed people and is thus the most advantageous arrangement for the majority of users; the insertion compartment with the greatest insertion height is provided on the left side so that the longer objects to be inserted there, for example, scissors, letter openers or also pencils, can be easily grasped and taken out. On the right side, there is the receiving compartment that is provided, for example, with an adhesive tape roll in the receiving compartment, and the roll can then be pulled off laterally to the right so that the pulled-off adhesive strip can be held with the right hand and can thus immediately be glued exactly where it is needed. The object to be provided with the adhesive tape can also be held with the left hand.

To be able to separate the pulled adhesive tape in a simple manner by a jerking motion, the edge of the side wall of the receiving compartment over which the unwound adhesive tape is guided advantageously has a cutting or ripping edge. It is thus not necessary separately to cut the unwound adhesive tape. A powerful tug with the hand that has pulled the adhesive tape off the roll will suffice. When the deposit compartment for the adhesive tape roll is arranged on the right side of the utensil container, the right hand would be used. The end of the adhesive tape here continues to adhere to the cutting edge. In order better to fix this loose end, the side wall, which is provided with a cutting edge, has a horizontal support bar that is arranged slightly below the level of the cutting edge and to which the free end of the adhesive strip can be affixed. This affixing action takes place in front of the cutting edge so that, first of all, there will be a secure adhesive attachment, and also there will be no protrusion of the adhesive tape that would have to be laboriously lifted off the outside wall and that under certain circumstances might no longer be adhesive.

To be able to separate the adhesive tape from this adhesive position, the front wall of the receiving compartment is provided with a recess that makes it possible to grasp the adhesive tape from underneath. In that way, the adhesive tape can be "lifted out" by a finger guided through this recess under the strip and can thus be separated from the support bar. For easier handling, this support bar can be provided with ribs that considerably reduce the adhesive surface and that thus also reduce the force necessary for separation.

The utensil container is connected in a force-locking or form-locking manner to the bulletin board, for example, by means of a screw connection or a gluing connection. It is advantageous to provide means for separating the utensil container from the ferromagnetic bulletin board. These means permit separation so that the utensil container can be used both with and without the bulletin board; one can also use differently sized bulletin boards and that increases their universality. As a means for separable attachment, one can provide knobs and corresponding holes which cooperate with each other in a form-locking or force-locking manner. The holes are preferably shaped as keyholes, so that after assembly, the knob can be guided through the large-diameter portion of the perforation and a thinner neck of the knob can be shifted into the adjoining narrow portion of the keyhole-like perforation, whereby the knob grasps behind the edge of the neck and thus fixes the container position. As an alternative, one can also provide the container with grooves that are arranged at least on three sides and into which the edges of the board can be inserted in a clamping manner; here, the holding action takes place via the clamping effect of such grooves, and this effect can be increased by corresponding design. Moreover, one can provide notches that fix the seat in addition to the clamping action; for example, elastic tongues or knobs can engage recesses in the lateral upper edges of the side bars, the recesses disposed on the edge of the bulletin board.

Advantageously, the bulletin board is provided with a coating that can be written on. This coating permits the direct placement of memory notes or communications without having to use any slips of paper. It is furthermore advantageous to coat the bulletin board on both sides and, again, both sides are advantageously coated with different colors; the bulletin board, thus coated, can be better adapted to the colors of the particular environment as "revolving board."

In another likewise preferred embodiment, there is provided a stand in which the utensil container can be inserted in a form-locking manner and that is so shaped that it constitutes an additional, essentially closed deposit space, together with the hook bar and the deposit cup arranged over it. This additional deposit space is advantageously subdivided by means of partitions.

Advantageously, in the utensil container, at least some of the partitions of insertion quiver, deposit compartment, deposit cup or the deposit space formed by means of the stand are made movable. This movability permits changing the available space dimensions for adaptation to the user's wishes. The partitions, for example, are guided between ribs that are provided in the sides of the solid walls.

Advantageously, the utensil container is made as a plastic part, preferably as a plastic injection-molded part. This design permits reasonably priced and economical production, especially if, as by way of a further development, the injection-molded part is made in one piece. Here, the knobs or grooves for the attachment of the bulletin board are molded upon the utensil container in one piece. To make sure that the tools needed to produce this object will not become too complicated, the hook bar is attached as a separate part.

To supply a pencil for marking the bulletin board or a wiper for erasing the notes entered upon it, there is preferably provided on one of the outside walls, preferably on the side wall of the insertion compartment on the left of the utensil container, at least one clip for a pencil, a hook for a rag or the like; in that way, the pencil for making notes on the coated bulletin board or the wiper for erasing such notes are effectively provided.

The utensil containers can also be so made that they can be lined up in a modular fashion next to each other and/or above each other; this applies regardless of whether or not they are provided with a bulletin board. The version provided with the stand can also be used for setting up with a smaller bulletin board. To be able to keep a stock of note paper, the hook bar (or the bulletin board) can also be provided with a receptacle for a paper roll, such as it is used, for example, in adding machines; here, it is advantageous if one also provides a tear-off rail that fixes the free end of the paper strip and that makes it possible simply to separate a desired segment of paper tape.

BRIEF DESCRIPTION OF THE DRAWINGS

The essence of the invention will be described in greater detail below with the help of the exemplary embodiments given in FIGS. 1 to 5; here.

DETAILED DESCRIPTION OF PREFERRED EMBODIMENTS OF THE INVENTION

Figure 1:
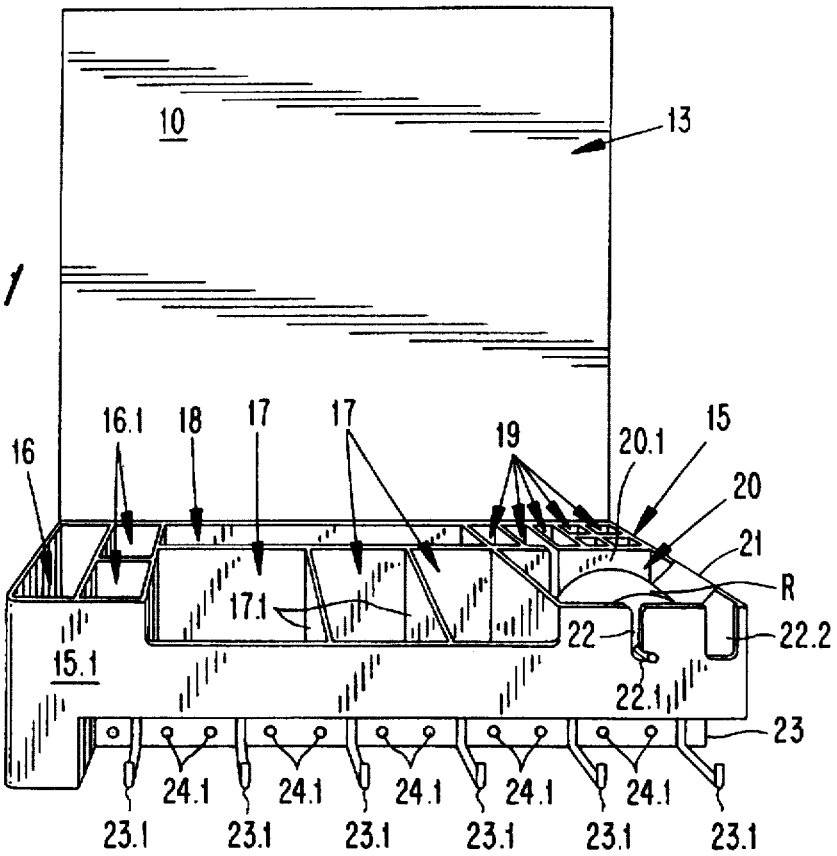
FIG. 1 is a schematic perspective view of the utensil container with bulletin board according to the invention.
Figure 2:
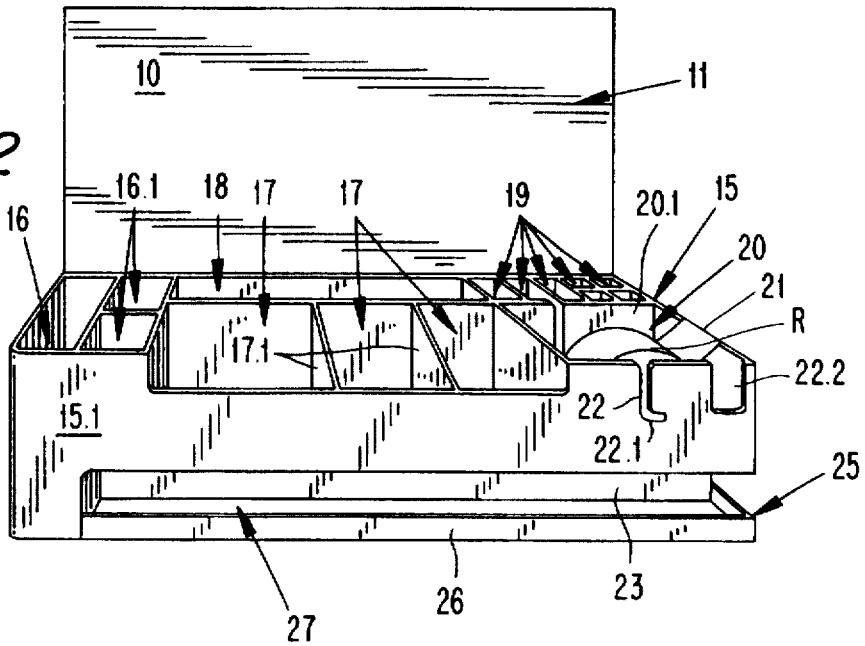
FIG. 2 is a schematic perspective view of the utensil container with bulletin board and stand.

FIGS. 1 and 2 show bulletin board 10, to which is mounted a utensil container 15. Bulletin board 10 here is provided with a surface coating 13 that makes it possible to write on it. Utensil container 15 is attached to the bulletin board. On its left side, this utensil container 15 has a quiver or compartment 16 that extends the entire height of the container 15 and receives longer objects, for example, scissors, screwdrivers and the like. Additional quivers 16.1 are provided; their adjustment height in the illustration, however, is reduced so that there exists a free space under these quivers 16.1 and that free space is closed off toward the rear by means of a hook bar 23. Adjoining these insertion quivers 16 and 16.1, there is another sector that forms a deposit cup 17 and a compartment 18 for slips of paper or slip pads. Deposit cup 17 is subdivided by partitions 17.1 that can be adjustable. Adjoining this deposit cup 17 and compartment 18 are additional receiving quivers or compartments 19 as well as a receiving compartment 20 for an adhesive tape roll R. This receiving compartment is formed by front wall 15.1 and a partition wall 20.1 (together with the necessary but not more specifically designated side walls). The adhesive tape is pulled off the roll via a rip-off edge 21. The lower space is intended for hooks, containers or the like that can be suspended from hook bar 23. For this purpose, hook bar 23 has holes 24.1 and slits 24.2 that are arranged in regular patterns and that facilitate this suspension action. The embodiment illustrated in FIG. 2 shows a bulletin board 10 with utensil container 15 and stand 25 that is attached to the utensil container from underneath. This utensil container 15 has a front edge 26 that is bent upward and that, together with the underside of deposit cup 17, defines an additional deposit space 27. While the design according to FIG. 1 is suspended on the wall, the design according to FIG. 2 is essentially intended as a floor-supported stand design, without being restricted to such use.

Figure 3:
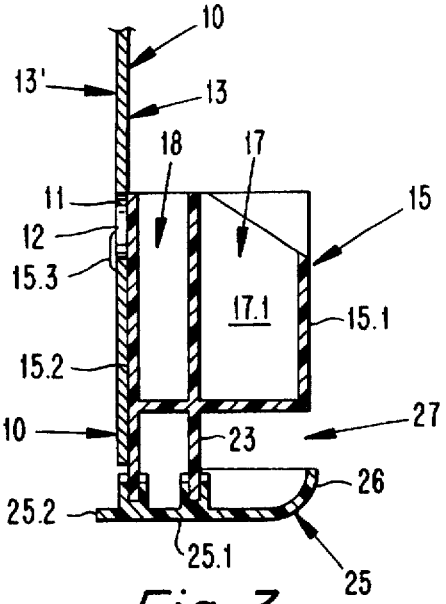
FIG. 3 is a vertical sectional view through the bulletin board with utensil container.

FIG. 3 shows a sectional view of the design of the exemplary embodiment with stand 25 taken centrally therethrough. Bulletin board 10 is provided with surface coating 13 that is provided on the "viewing side". Regardless, however, the reverse side of bulletin board 10 can also be provided with a possibly differently colored coating 13'; the bulletin board can then also be used as a rotating board. Utensil container 15 is provided on its reverse side 15.2 with knobs 15.1 that cooperate with holes 11 of bulletin board 10. To be able to fix utensil container 15 upon bulletin board 10, holes 11 are provided with projections or necks 12 (see FIG. 5) that have a reduced width when compared to the diameter of the holes 11 and that thus enable knobs 15.3 to grasp the board from behind. Stand 25 is set against utensil container 15, so that double bars form slots that receive the lower edges of rear wall 15.2 and hook bar 23 and hold them by way of a clamping action. The stand 25 forms the deposit floor of the additional deposit compartment 27; front edge 26 of the compartment has a bent-up portion that, first of all, prevents small objects placed in the additional deposit compartment from falling out and that, besides, makes it easier to remove these objects by virtue of its bent-up portion. With its base side 25.1, stand 25 can be stood up on a surface; a rearward protrusion 25.2 prevents tilting, especially when utensil container 15 is placed against a high bulletin board 10.

Figure 4:
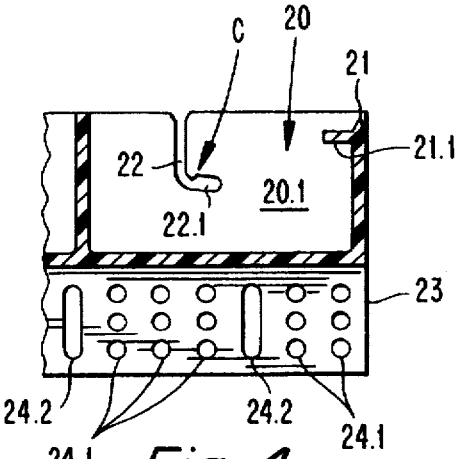
FIG. 4 is a sectional view through the reception compartment for the adhesive tape roll.

FIG. 4 shows a cross section taken through the stand along a plane oriented parallel to the rear wall and looking toward partition 20.1. The latter has an axle receptacle slot or groove 22 that is the same as another axle reception slot 22 formed in front wall 15.1. This axle receptacle slot 22 includes a vertical upper portion and a lower portion 22.1 that is oriented generally perpendicularly thereto although inclined slightly downward. The lower portion 22.1 forms an axle bearing for the axle stub of the tape roll. By virtue of this inclination of the lower portion 22.1, an adhesive tape roll inserted on a core with axle stub, that is pulled into the terminal position of the portion 22.1 as the adhesive tape is unwound, will have a tendency to remain in place there even as the tension abates. The lower portion 22.1 of the groove may have a constriction C which yieldably resists removal of the axle stub.

The drawn-off adhesive tape is moved out laterally, specifically via cutting or rip-off edge 21 whose rip-off teeth are roughly flush with the upper edge of the side wall. The drawn adhesive tape sticks to rip-off edge 21. It is advantageous to provide a support bar 21.1 slightly below the edge 21; the free end of the drawn adhesive tape will stick to that bar and will thus be protected against becoming entangled.

To be able to pull the adhesive tape off the bar, a recess 22.2 is provided in the front wall 15.1 in the area of the receiving compartment for the adhesive tape roll; this recess makes it possible to grasp the adhesive tape from underneath and thus facilitates the simple release of the adhesive tape, regardless of whether the adhesive tape sticks to rip-off edge 21 or to the supporting bar. Below the receptacle compartment 20 for the adhesive tape roll, there is provided the hook bar 23 with holes 24.1 and slits 24.2 arranged in a regular pattern, and it goes without saying that one can use either only holes 24.1 or only slits 24.2 or also both combined, as illustrated.

Figure 5:
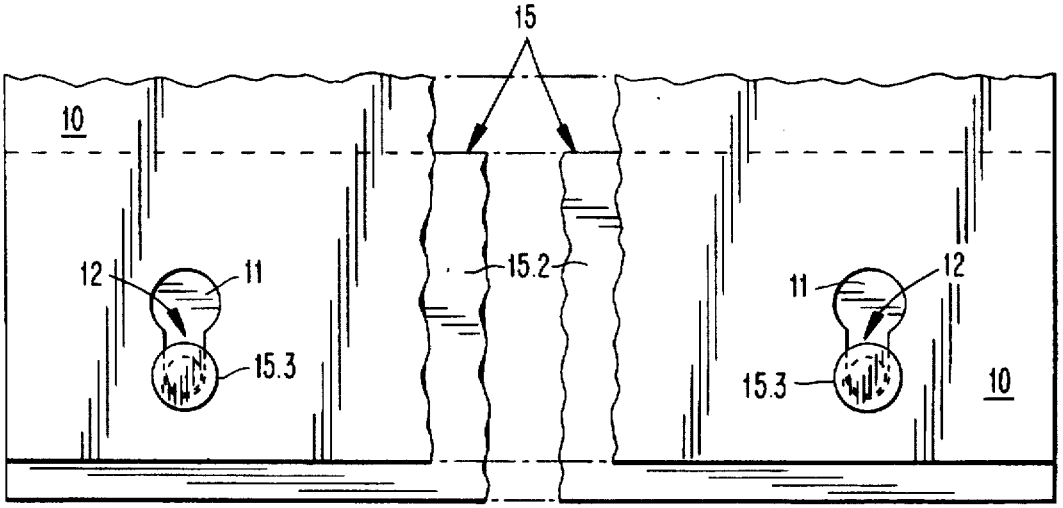
FIG. 5 shows a detail of the connection of the bulletin board and the utensil container (double-broken-off rear view).

Finally, FIG. 5 shows an embodiment of an attachment of the utensil container 15 to the rear wall 10. Knobs 15.3, provided on rear wall 15.2 of utensil container 15, are so fashioned that their heads can be guided through holes 11 in bulletin board 10; the necks of knobs 15.3, whose length roughly corresponds to the thickness of bulletin board 10, on the other hand, have a smaller diameter. Holes 11 of bulletin board 10 have downward extensions of reduced width, so that the holes appear keyhole-like. The width of the extension is such that the necks of knobs 15.3 can be inserted in these extensions. In the process, the heads of the knobs grasp the board 10 behind the edges of the perforation and thus fix the utensil container is that is placed against bulletin board 10.

Although the present invention has been described in connection with preferred embodiments thereof, it will be appreciated by those skilled in the art that additions, deletions, modifications, and substitutions not specifically described may be made without departing from the spirit and scope of the invention as defined in the appended claims.

What is claimed is:

1. A bulletin board structure comprising a ferromagnetic board that is coated so that it can be written on, the board including a lower edge; a depository disposed along the lower edge; the depository comprising a utensil container that has at least one vertical compartment that is open on top;

wherein the utensil container is divided onto upper and lower sectors, the compartment disposed in the upper sector, and the lower sector having a receptacle for objects.

2. The bulletin board structure according to claim 1 wherein the at least one compartment comprises a plurality of open-top vertical compartments.

3. The bulletin board structure according to claim 1 wherein the depository is removably mounted to the board.

4. The bulletin board according to claim 1 wherein the receptacle is a hook bar that has separably attachable hooks.

5. The bulletin board according to claim 1 wherein the receptacle is a horizontal deposit compartment.

6. The bulletin board according to claim 5 wherein at a center of the upper sector there is provided a deposit cup which is subdivided by partitions and which is bordered by a first partition wall extending parallel to the board, and an insertion compartment having a depth of at most ¼ of the depth of the deposit cup and disposed therebehind.

7. The bulletin board according to claim 2 wherein at least one of the compartments extends the entire height of the utensil container.

8. The bulletin board according to claim 2 wherein one of the compartments constitutes an adhesive tape roll receiving compartment, opposing walls of which are each provided with means for receiving axle stubs of the adhesive tape roll.

9. The bulletin board according to claim 8 wherein the means for receiving axle stubs comprises a slot.

10. The bulletin board according to claim 9 wherein the slots are L-shaped with an upwardly open leg and a lower leg extending roughly in the direction in which the adhesive tape is pulled off.

11. The bulletin board according to claim 10 wherein each slot includes a yieldable constriction for resisting removal of the axle stub.

12. The bulletin board according to claim 9 wherein the utensil container further includes a deposit cup which is subdivided by partitions, the compartment disposed to one side of the deposit cup, and the tape roll-receiving compartment disposed to an opposite side thereof.

13. The bulletin board according to claim 9 wherein an edge of a vertical wall forming the tape roll-receiving compartment is a sharp cutting edge.

14. The bulletin board according to claim 12 wherein the vertical wall includes a horizontal support bar extending inwardly toward the center of the tape roll-receiving compartment at an elevation lower than the cutting edge to form a surface to which tape of the roll can be adhered.

15. The bulletin board according to claim 9 wherein a wall forming the tape roll-receiving compartment includes a finger access recess enabling the adhesive tape to be grasped from underneath.

16. The bulletin board according to claim 1 wherein the utensil container is removably connected to the ferromagnetic bulletin board by a knob-and-hole connection.

17. The bulletin board according to claim 1 wherein the utensil container includes grooves on at least three sides thereof, into which lower edges of the bulletin board are inserted in a clamping manner.

18. The bulletin board according to claim 4, further including a floor-support stand into which the utensil container is inserted, the hook bar disposed above the stand and forming therewith an additional deposit space.

19. The bulletin board according to claim 6 wherein at least some of the partitions are movable.

20. The bulletin board according to claim 1 wherein the utensil container is formed of plastic.

21. The bulletin board according to claim 20 wherein the utensil container is of one-piece molded construction.

22. A bulletin board structure comprising a ferromagnetic board that is coated so that it can be written on, the board including a lower edge; a depository disposed along the lower edge; the depository comprising a utensil container that has at least one vertical compartment that is open on top; wherein the depository is removably mounted to the board.

23. A bulletin board structure comprising a ferromagnetic board that is coated so that it can be written on, the board including a lower edge; a depository disposed along the lower edge; the depository comprising a utensil container that has at least one vertical compartment that is open on top; wherein the utensil container is removably connected to the ferromagnetic bulletin board by a knob-and-hole connection.

24. A bulletin board structure comprising a ferromagnetic board that is coated so that it can be written on, the board including a lower edge; a depository disposed along the lower edge; the depository comprising a utensil container that has at least one vertical compartment that is open on top; wherein the utensil container includes grooves on at least three sides thereof, into which lower edges of the bulletin board are inserted in a clamping manner.

* * * * *